US008578570B1

(12) United States Patent
Dwight

(10) Patent No.: US 8,578,570 B1
(45) Date of Patent: Nov. 12, 2013

(54) SILENCER PATCH FOR HOOK-AND LOOP CLOSURE SYSTEM

(75) Inventor: Mark M. Dwight, San Francisco, CA (US)

(73) Assignee: Rickshaw Bagworks, San Francisco, CA (US)

( * ) Notice: Subject to any disclaimer, the term of this patent is extended or adjusted under 35 U.S.C. 154(b) by 580 days.

(21) Appl. No.: 12/353,859

(22) Filed: Jan. 14, 2009

(51) Int. Cl.
*A44B 18/00* (2006.01)

(52) U.S. Cl.
USPC ..... 24/306; 24/303

(58) Field of Classification Search
USPC ..... 24/306, 442–452, 303; 2/920, 912, 2/69.5; 224/183, 901.2, 901.6, 901.8, 224/620, 658
See application file for complete search history.

(56) References Cited

U.S. PATENT DOCUMENTS

| | | | | | |
|---|---|---|---|---|---|
| 2,262,313 | A | | 11/1941 | Clappier | |
| 4,498,615 | A | * | 2/1985 | Johnson | 224/274 |
| 4,611,355 | A | * | 9/1986 | Galanto et al. | 2/246 |
| 4,776,043 | A | * | 10/1988 | Coleman | 2/209.12 |
| 4,776,068 | A | * | 10/1988 | Smirlock et al. | 24/442 |
| 4,850,502 | A | * | 7/1989 | Davis | 220/759 |
| 4,878,606 | A | | 11/1989 | Miller | |
| 4,879,787 | A | * | 11/1989 | Walls | 24/712.2 |
| 4,884,323 | A | * | 12/1989 | Provost et al. | 24/442 |
| 4,885,195 | A | * | 12/1989 | Change, III | 428/36.1 |
| 4,937,920 | A | * | 7/1990 | Tsai | 24/3.3 |
| 4,939,818 | A | * | 7/1990 | Hahn | 24/16 R |
| 5,214,874 | A | * | 6/1993 | Faulkner | 43/25.2 |
| 5,282,616 | A | * | 2/1994 | Stacavich-Notaro | 473/406 |
| 5,359,733 | A | * | 11/1994 | Brannon et al. | 2/195.1 |
| 5,379,491 | A | * | 1/1995 | Solo | 24/3.3 |
| 5,412,545 | A | * | 5/1995 | Rising | 362/105 |
| 5,422,156 | A | * | 6/1995 | Billarant | 428/100 |
| 5,443,192 | A | * | 8/1995 | Hodges et al. | 224/148.6 |
| 5,533,809 | A | * | 7/1996 | Gorman | 383/11 |
| 5,593,073 | A | * | 1/1997 | Finnegan | 224/183 |
| 5,611,122 | A | * | 3/1997 | Torigoe et al. | 24/442 |
| 5,655,268 | A | * | 8/1997 | Keyaki et al. | 24/114.9 |
| 5,732,448 | A | | 3/1998 | Shields et al. | |
| 5,758,972 | A | * | 6/1998 | Mack et al. | 5/503.1 |
| 5,762,241 | A | * | 6/1998 | Cross | 224/173 |
| 5,954,253 | A | * | 9/1999 | Swetish | 224/631 |
| 5,984,154 | A | * | 11/1999 | Scicluna | 224/153 |
| 6,146,324 | A | * | 11/2000 | Engel | 600/15 |
| 6,163,889 | A | * | 12/2000 | Tate | 2/209.13 |
| 6,168,057 | B1 | * | 1/2001 | Schwabe | 224/269 |
| 6,175,963 | B1 | * | 1/2001 | Loeffelholz | 2/209.13 |
| 6,519,779 | B1 | * | 2/2003 | Taguchi | 2/209.12 |
| 6,546,599 | B2 | * | 4/2003 | Pelt et al. | 24/3.1 |
| 6,626,342 | B1 | | 9/2003 | Gleason | |
| 6,756,097 | B2 | * | 6/2004 | Baker et al. | 428/40.1 |

(Continued)

*Primary Examiner* — Robert J Sandy
*Assistant Examiner* — Rowland D Do
(74) *Attorney, Agent, or Firm* — Haverstock & Owens

(57) ABSTRACT

A silencer patch including a body having a first surface and a second surface opposite the first surface; a set of hook-and-loop-type fasteners disposed on the first surface of the body, wherein the set of hook-and-loop-type fasteners includes either a plurality of hooks or a plurality of loops and is configured to releasably secure the first surface of the body to a corresponding set of hook-and-loop-type fasteners disposed on a first separate body; and an alternative fastener disposed on the body and configured to releasably secure the second surface of the body to a corresponding alternative fastener disposed on a second separate body, wherein the alternative fastener is not a hook-and-loop-type fastener.

12 Claims, 5 Drawing Sheets

(56) References Cited

U.S. PATENT DOCUMENTS

| | | | | |
|---|---|---|---|---|
| 6,802,442 | B1 | 10/2004 | Thompson | |
| 6,932,667 | B1 * | 8/2005 | Koxlien | 446/26 |
| 7,152,283 | B2 * | 12/2006 | Murayama et al. | 24/442 |
| 7,373,696 | B2 * | 5/2008 | Schoening et al. | 24/66.1 |
| 7,404,241 | B2 * | 7/2008 | Murayama et al. | 24/444 |
| 2004/0188483 | A1 * | 9/2004 | Kato et al. | 224/576 |
| 2005/0262670 | A1 * | 12/2005 | Cheng | 24/442 |
| 2007/0089646 | A1 * | 4/2007 | Duncan | 108/43 |
| 2007/0199966 | A1 * | 8/2007 | Korchmar | 224/578 |
| 2009/0036219 | A1 * | 2/2009 | Crouch et al. | 463/43 |
| 2010/0147918 | A1 | 6/2010 | Hensley et al. | |
| 2010/0155001 | A1 * | 6/2010 | Bolton | 160/368.1 |
| 2010/0275419 | A1 * | 11/2010 | Millus | 24/306 |
| 2011/0179605 | A1 * | 7/2011 | Slank | 24/306 |

* cited by examiner

SILENCER PATCH FOR HOOK-AND LOOP CLOSURE SYSTEM

FIELD OF THE INVENTION

The present invention relates to the field of hook-and-loop fastening systems. More specifically, the present invention relates to a patch configured to avoid the noise and damage associated with hook-and-loop fastening systems.

BACKGROUND OF THE INVENTION

Traditional messenger bags, such as bag 100 in FIG. 1A, feature a hook-and-loop flap closure (commonly referred to by the trade name "Velcro"). Hook-and-loop patches 130 and 140 are disposed on the main body 110 of the bag 100 and on the inside of the flap 120 of the bag 100. The hook-and-loop patches are often accompanied by plastic buckles 150, which are used to secure the flap 120 to the main body 110 for added security. Additionally, a strap 160 is often included to aid in carrying the bag 100.

As seen in FIGS. 1B-C, the hook-and-loop patch 130 comprises a plurality of hooks (such as a hook matrix) 135 disposed on its exposed surface, while the hook-and-loop patch 140 comprises a plurality of loops (such as a loop matrix) 145 disposed on its exposed surface. When the hooks 135 of the patch 130 and the loops 145 of the patch 140 are brought into contact with one another, such as by closing the flap 120 over the main body 110 of the bag 100, the hooks 135 and loops 145 releasably interlock, allowing the patches 130 and 140 (and thus main body 110 and flap 120) to be secured to one another, while still allowing them to be conveniently separated when desired.

While the hook-and-loop closure system is convenient and effective, it has a number of drawbacks which result in customer dissatisfaction and product quality issues.

One drawback of the traditional hook-and-loop closure system is noise. The "clip and rip" sound, especially the ripping noise from the hook-and-loop patches, can be distracting and disruptive when opening the bag in quiet classroom, library and meeting settings.

Another drawback is garment damage. The hook side of the hook-and-loop closure naturally grabs onto woven fabrics, especially Lycra, cashmere and wool, and damages the fabric (commonly referred to as "picking" at the fabric). This picking can cause permanent cosmetic damage to the garment. Users of these traditional hook-and-loop closure systems complain about exposed hook patches damaging their yoga and athletic workout outfits, and expensive professional suits.

Yet another drawback is bag fabric damage. As with garment damage, the hook side of the hook-and-loop closure an also "attack" the base fabric of the bag itself, strap webbing and key tether webbing, resulting in an unattractive "fuzzy" surface finish.

Yet another drawback is lint collection. The hook side of the hook-and-loop closure system is a magnet for lint, thread and hair, which catches in the hook matrix and is difficult to pick out with your fingers. The hook patches are cosmetically unattractive when clogged with this foreign material.

Yet another drawback is degradation of hold strength. The hold strength of the hook-and-loop patches degrades with extended use, as both the hooks and loops break.

Yet another drawback is the perceived quality and style. In general, the traditional hook-and-loop closure system is used on lower-priced soft goods and utilitarian outdoor products, rather than expensive, stylish luxury goods, which tend to feature more elegant metal closure systems.

SUMMARY OF THE INVENTION

The present invention overcomes the deficiencies of the prior art by providing a silencer patch that is configured to be placed over an existing hook-and-loop fastener to cover the offending side of the existing hook-and-loop closure system. The silencer patch of the present invention enables two components that previously relied on hook-and-loop-type fasteners for attachment to be releasably secured to one another without the use of the existing hook-and-loop-type fasteners on the two components, relying instead on an alternative fastener.

In one aspect of the present invention, a silencer patch is disclosed. The silencer patch comprises a body having a first surface and a second surface opposite the first surface, a set of hook-and-loop-type fasteners disposed on the first surface of the body, and an alternative fastener disposed on the body and configured to releasably secure the second surface of the body to a corresponding alternative fastener disposed on a second separate body. The set of hook-and-loop-type fasteners comprises either a plurality of hooks or a plurality of loops and is configured to releasably secure the first surface of the body to a corresponding set of hook-and-loop-type fasteners disposed on a first separate body. The alternative fastener is not a hook-and-loop-type fastener.

In some embodiments, the set of hook-and-loop-type fasteners comprises a plurality of hooks and the corresponding set of hook-and-loop-type fasteners comprises a plurality of loops. In other embodiments, the set of hook-and-loop-type fasteners comprises a plurality of loops and the corresponding set of hook-and-loop-type fasteners comprises a plurality of hooks.

In some embodiments, the alternative fastener comprises one or more magnets and the corresponding alternative fastener comprises one or more magnets. In some embodiments, the alternative fastener comprises one or more magnets enclosed within the body between the first surface and the second surface. In some embodiments, the alternative fastener is disposed between layers of fabric.

In other embodiments, the alternative fastener comprises a mechanical fastener disposed on the second surface of the body and configured to releasably interlock with a corresponding mechanical fastener disposed on a surface of the second separate body. In some embodiments, the mechanical fastener comprises at least one of the mechanical fasteners selected from the group consisting of snap fasteners, hook fasteners, and slide fasteners.

In another aspect of the present invention, a silencer system is disclosed. The silencer system comprises a first patch body, having a first surface and a second surface opposite the first surface, and a second patch body, having a first surface and a second surface opposite the first surface. The first patch body comprises a plurality of hooks disposed on the first surface of the first patch body and configured to releasably secure the first surface of the first patch body to a corresponding plurality of loops disposed on a first separate body, and a first alternative fastener. The alternative fastener is not a hook-and-loop-type fastener. The second patch body comprises a plurality of loops disposed on the first surface of the second patch body and configured to releasably secure the first surface of the second patch body to a corresponding plurality of hooks disposed on a second separate body, and a second alternative fastener configured to releasably secure the second surface of the second patch body to the first alternative fastener disposed on the first patch body. The second alternative fastener is not a hook-and-loop type fastener.

In some embodiments, the first separate body and the second separate body are both disposed on the same messenger bag.

In some embodiments, the first alternative fastener and the second alternative fastener each comprises one or more magnets. In some embodiments, the first alternative fastener comprises one or more magnets enclosed within the first patch body between the first surface and the second surface of the first patch body, and the second alternative fastener comprises one or more magnets enclosed within the second patch body between the first surface and the second surface of the second patch body. In some embodiments, the first alternative fastener and the second alternative fastener are each disposed between layers of fabric.

In other embodiments, the first alternative fastener comprises a first mechanical fastener disposed on the second surface of the first patch body, and the second alternative fastener comprises a second mechanical fastener disposed on the second surface of the second patch body. The second alternative fastener is configured to releasably interlock with the first mechanical fastener. In some embodiments, the first mechanical fastener and the second mechanical fastener each comprises at least one of the mechanical fasteners selected from the group consisting of snap fasteners, hook fasteners, and slide fasteners.

In yet another aspect of the present invention, a silencer system is disclosed. The silencer system comprises a first hook-and-loop surface, disposed on a first hook-and-loop body and comprising a set of hook-and-loop-type fasteners, and a first patch body, having a first surface, a second surface opposite the first surface, a set of hook-and-loop-type fasteners disposed on the first surface of the first patch body, and a first alternative fastener. The set of hook-and-loop-type fasteners on the first hook-and-loop surface comprises either a plurality of hooks or a plurality of loops. The set of hook-and-loop-type fasteners on the first patch body comprises either a plurality of hooks or a plurality of loops and is configured to releasably secure the first surface of the first patch body to the set of hook-and-loop-type fasteners disposed on the first hook-and-loop surface. The first alternative fastener is configured to releasably secure the second surface of the first patch body to a corresponding alternative fastener disposed on a separate body. The first alternative fastener is not a hook-and-loop-type fastener.

In some embodiments, the silencer system further comprises a second hook-and-loop surface and a second patch body. The second hook-and-loop surface comprises a set of hook-and-loop-type fasteners, which comprises either a plurality of hooks or a plurality of loops. The second patch body has a first surface, a second surface opposite the first surface, a set of hook-and-loop-type fasteners disposed on the first surface of the first patch body, and a second alternative fastener. The set of hook-and-loop-type fasteners on the second patch body comprises either a plurality of hooks or a plurality of loops and is configured to releasably secure the first surface of the second patch body to the set of hook-and-loop-type fasteners disposed on the second hook-and-loop surface. The second alternative fastener is the corresponding alternative fastener and is configured to releasably secure the second surface of the second patch body to the first alternative fastener disposed on the first patch body. The second alternative fastener is not a hook-and-loop-type fastener. In some embodiments, the first hook-and-loop surface and the second hook-and-loop surface are both disposed on the same messenger bag. In some embodiments, the first alternative fastener and the second alternative fastener each comprises one or more magnets. In other embodiments, the first alternative fastener and the second alternative fastener each comprises one or more mechanical fasteners.

In other embodiments, the silencer system further comprises a second hook-and-loop surface and a second alternative fastener. The second hook-and-loop surface is disposed on a second hook-and-loop body and comprises a set of hook-and-loop-type fasteners. The set of hook-and-loop-type fasteners comprises either a plurality of hooks or a plurality of loops. The second alternative fastener is disposed on the second hook-and-loop body and is configured to releasably secure the second hook-and-loop body to the first alternative fastener disposed on the first patch body. The second alternative fastener is not a hook-and-loop-type fastener. In some embodiments, the first alternative fastener and the second alternative fastener each comprises one or more magnets. In some embodiments, the second alternative fastener comprises one or more magnets encased within the second hook-and-loop body and disposed underneath the second hook-and-loop surface. In some embodiments, the first hook-and-loop body and the second hook-and-loop body are both disposed on the same messenger bag, and the set of hook-and-loop fasteners on the first hook-and-loop surface are configured to releasably interlock with the set of hook-and-loop-type fasteners on the second hook-and-loop body.

DETAILED DESCRIPTION OF THE INVENTION

The following description is presented to enable one of ordinary skill in the art to make and use the invention and is provided in the context of a patent application and its requirements. Various modifications to the described embodiments will be readily apparent to those skilled in the art and the generic principles herein may be applied to other embodiments. Thus, the present invention is not intended to be limited to the embodiment shown but is to be accorded the widest scope consistent with the principles and features described herein.

This disclosure provides several embodiments of the present invention. It is contemplated that any features from any embodiment can be combined with any features from any other embodiment. In this fashion, hybrid configurations of the illustrated embodiments are well within the scope of the present invention.

The present invention provides a unique closure system comprised of one or more silencer patches that are configured to be placed over the existing hook patches and/or loop patches to cover the offending side(s) of the existing hook-and-loop closure system. Each silencer patch comprises a set of hook-and-loop-type fasteners, for securing the silencer patch to and covering the existing hook-and-loop-type fasteners on the target article (e.g., the messenger bag), and an alternative fastener, for releasably securing the silencer patch to a corresponding alternative fastener.

Figure 1A:
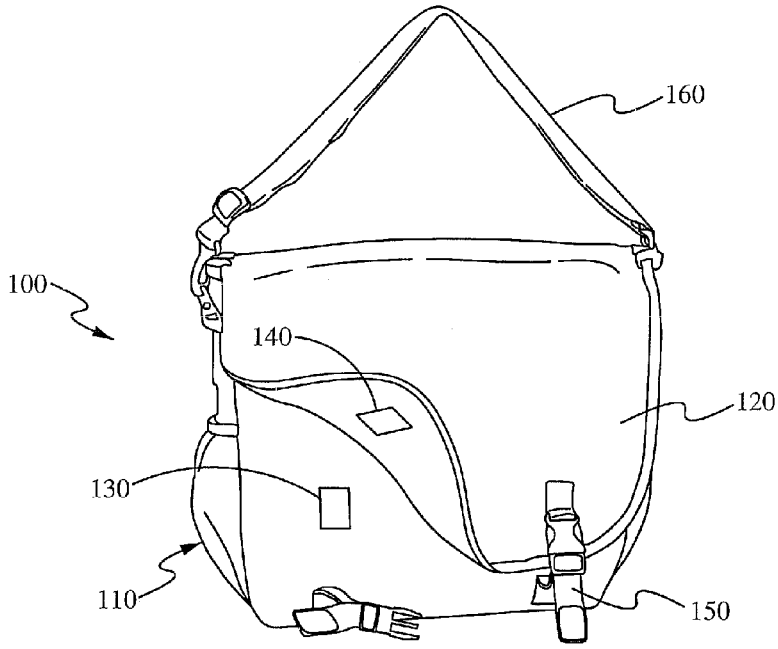
Fig. 1A (Prior Art)
FIGS. 1A-C illustrate a messenger bag with a prior art hook-and-loop closure system.
Figure 1B:
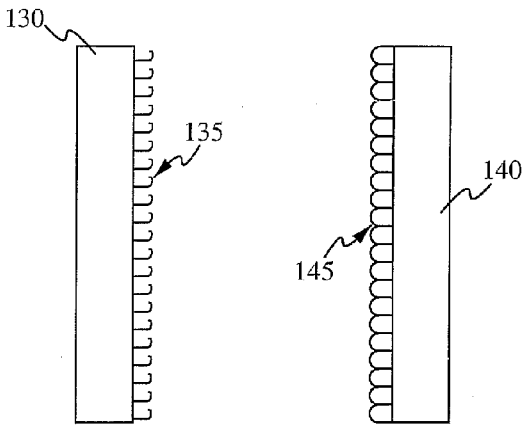
Fig. 1B (Prior Art)
Figure 1C:
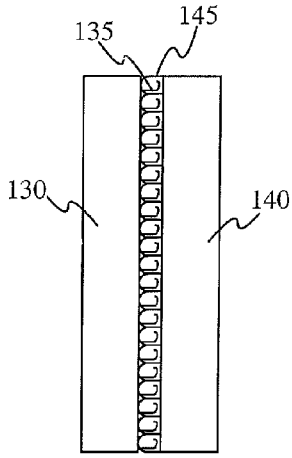
Fig. 1C (Prior Art)
Figure 2A:
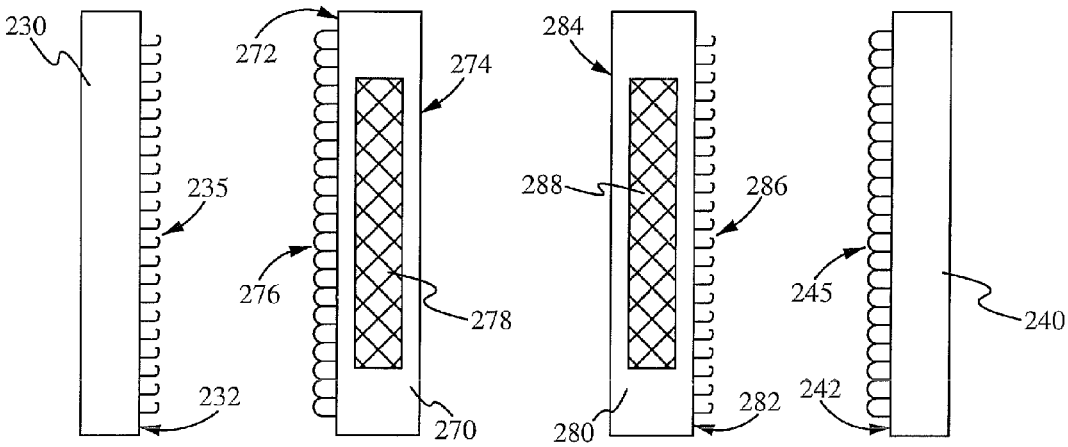
FIGS. 2A-C illustrate one embodiment of a silencer patch system in accordance with the principles of the present invention.
Figure 2B:
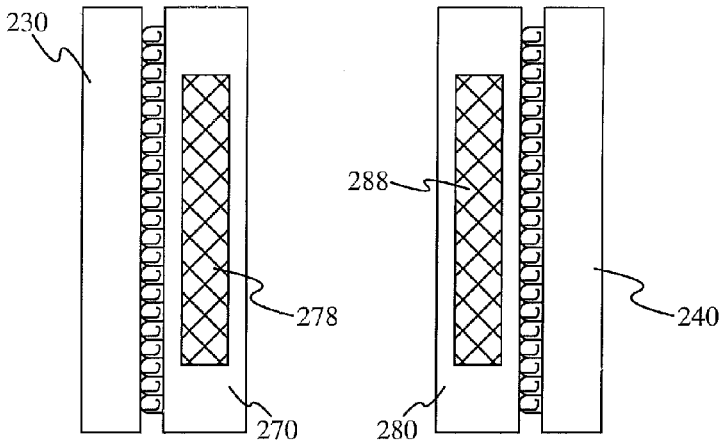
Figure 2C:
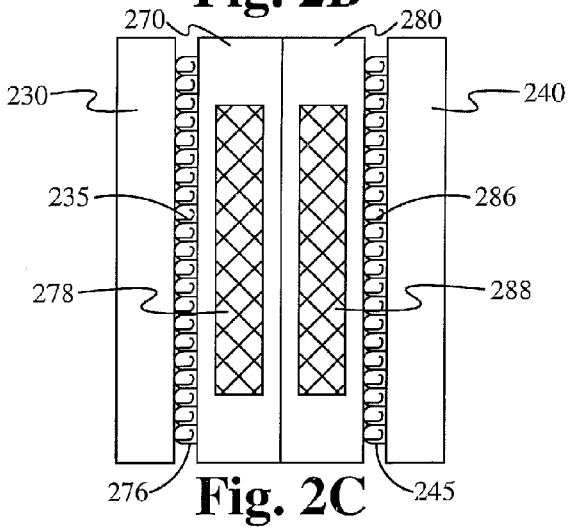

FIGS. 2A-C illustrate one embodiment of a silencer patch system in accordance with the principles of the present invention. Hook patch 230 comprises a plurality of hooks (e.g., a hook matrix) 235 extending out from its exposed surface 232. Loop patch 240 comprises a plurality of loops (e.g., a loop matrix) 245 extending out from its exposed surface 242. In some embodiments, the hook patch 230 and the loop patch 240 represent an existing hook-and-loop-type closure system securely fixed on a target article, similar to hook-and-loop patches 130 and 140 discussed above with respect to FIGS. 1A-C. In some embodiments, one of the patches 230 and 240 is fixed to the main body of a bag, such as main body 110 of messenger bag 100, while the other patch is fixed to the flap of the bag, such as the flap 120 of messenger bag 100. In some embodiments, the body of patches 230 and 240 are fastened (e.g., sewn, adhered, etc.) to the target article, while in other embodiments, the body of patches 230 and 240 are integrally formed with the target article.

The silencer patch system in FIGS. 2A-C comprises a loop silencer patch 270 and a hook silencer patch 280. The loop silencer patch 270 comprises a body having a first surface 272 and a second surface 274 opposite the first surface 272. Although the surfaces 272 and 274 are shown as being substantially planar, it is contemplated that the surfaces of loop silencer patch 270 can be formed in a variety of ways. A plurality of hook-and-loop-type fasteners 276 are disposed on and extends from the first surface 272 of the loop silencer patch 270. The plurality of hook-and-loop-type fasteners 276 comprises a plurality of tiny loops configured to releasably secure the first surface 272 of the loop silencer patch 270 to the corresponding plurality of hooks 235 disposed on separate hook patch 230 as seen in FIG. 2B.

Similarly, hook silencer patch 280 comprises a body having a first surface 282 and a second surface 284 opposite the first surface 282. Although the surfaces 282 and 284 are shown as being substantially planar, it is contemplated that the surfaces of loop silencer patch 280 can be formed in a variety of ways. A plurality of hook-and-loop-type fasteners 286 are disposed on and extends from the first surface 282 of the hook silencer patch 280. The plurality of hook-and-loop-type fasteners 286 comprises a plurality of tiny hooks configured to releasably secure the first surface 282 of the hook silencer patch 280 to the corresponding plurality of loops 245 disposed on separate loop patch 240 as seen in FIG. 2B.

The loop silencer patch 270 and the hook silencer patch 280 each comprise an alternative fastener disposed on their respective bodies. The alternative fastener on each body is configured to releasably secure the body to a corresponding alternative fastener disposed on another separate body, as seen in FIG. 2C with the body of loop silencer patch 270 being releasably secured to the body of hook silencer patch 280 using their alternative fasteners. The alternative fastener is characterized by not being a hook-and-loop-type fastener. In some embodiments, the alternative fastener is a magnet. In some embodiments, in addition to or as an alternative to magnets, the alternative fastener comprises mechanical fasteners, including, but not limited to, mechanical snaps, hooks, sliders, and other types of closures. It is noted that the alternative fastener hooks are distinguished from the tiny bendable hooks used in hook-and-loop-type fasteners. The alternative fastener hook system is configured to not be simply ripped apart as with the hook-and-loop-type fasteners, but rather uses a larger and firmer hook configured to be unhooked by the user without applying significant stress on the corresponding component with which the alternative fastener hook is interlocked.

In FIGS. 2A-C, the loop silencer patch 270 the hook silencer patch 280 employ magnets as their alternative fasteners. Magnets 278 and 288 are disposed within the bodies of the loop silencer patch 270 and the hook silencer patch 280, respectively. In some embodiments, these silencer patches are made of fabric with one side having a hook-and-loop-type fastener for securing the patch to a corresponding hook-and-loop-type fastener on the target article. Additionally, in some embodiments, the silencer patches are outfitted with one or more magnets, sandwiched between the fabric layers of the patch. These magnets mate with attractive magnets sandwiched into opposing closure patches, as seen in FIG. 2C with the magnets 278 and 288 being attracted to one another and, thereby, releasably securing the loop silencer patch 270 to the hook silencer patch 280. In some embodiments, the magnets 278 and 288 are disposed on the exterior of surfaces 274 and 284 respectively, thereby leaving the magnets exposed.

As discussed above, the silencer patch system of the present invention is capable of being used to retrofit any bag, or other target article, that employs a hook-and-loop closure system. Additionally, the silencer patch system of the present invention is also capable of being built-in to the bag or other target article at the time of manufacture. In some embodiments, an alternative fastener is disposed on one side of the existing closure system on the target article. For example, in some embodiments, one or more magnets are sandwiched behind the standard hook-and-loop-type closure patch on the bag at the time of manufacture.

Figure 3A:
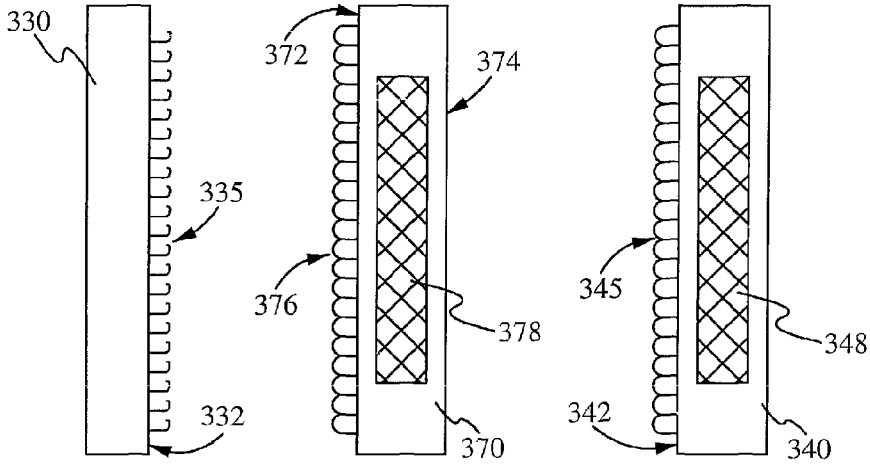
FIGS. 3A-C illustrate another embodiment of a silencer patch system in accordance with the principles of the present invention.
Figure 3B:
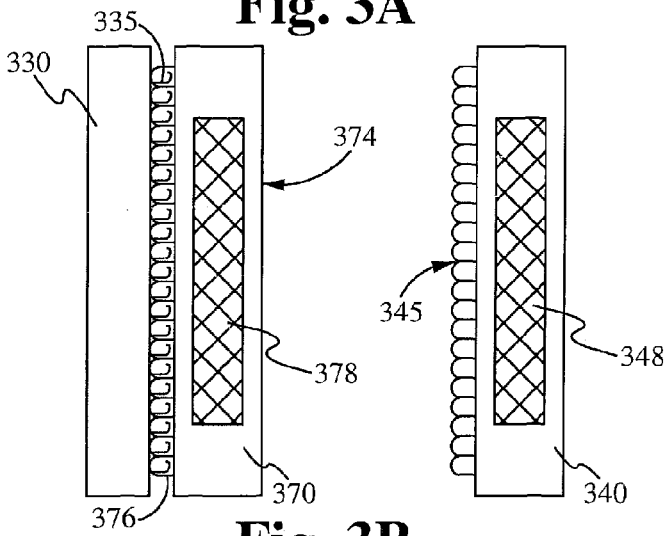
Figure 3C:
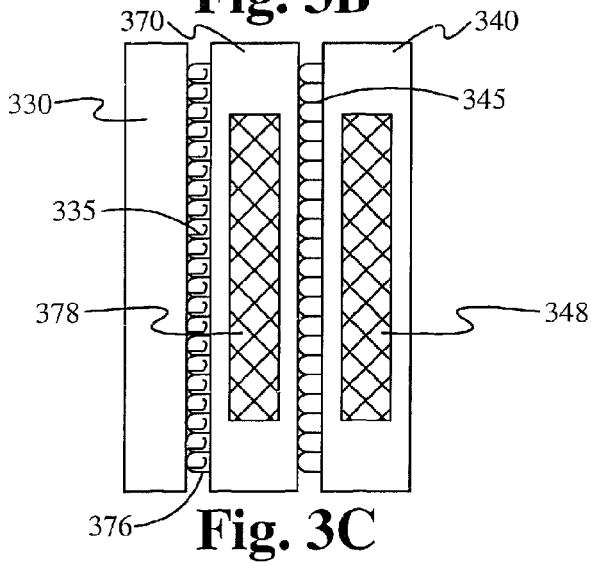

FIGS. 3A-C illustrate one embodiment of a silencer patch system having an alternative fastener built into the loop side of the existing hook-and-loop-type closure system on the target article. In this embodiment, the hook patch 330 and the loop patch 340 represent an existing hook-and-loop-type closure system securely fixed on a target article, similar to the hook-and-loop patches 230 and 240 discussed above with respect to FIGS. 2A-C. The hook patch 330 comprises a plurality of hooks (e.g., a hook matrix) 335 extending out from its exposed surface 332. The loop patch 340 comprises a plurality of loops (e.g., a loop matrix) 345 extending out from its exposed surface 342. In some embodiments, one of the patches 330 and 340 is fixed to the main body of a bag, such as the main body 110 of the messenger bag 100, while the other patch is fixed to the flap of the bag, such as the flap 120 of messenger bag 100. In some embodiments, the body of patches 330 and 340 are fastened (e.g., sewn, adhered, etc.) to the target article, while in other embodiments, the body of patches 330 and 340 are integrally formed with the target article.

The silencer patch system in FIGS. 3A-C also comprises a loop silencer patch 370. The loop silencer patch 370 comprises a body having a first surface 372 and a second surface 374 opposite the first surface 372. Although surfaces 372 and 374 are shown as being substantially planar, it is contemplated that the surfaces of loop silencer patch 370 can be formed in a variety of ways. A plurality of hook-and-loop-type fasteners 376 is disposed on and extends from the first surface 372 of the loop silencer patch 370. The plurality of hook-and-loop-type fasteners 376 comprises a plurality of tiny loops configured to releasably secure the first surface 372 of the loop silencer patch 370 to the corresponding plurality of hooks 335 disposed on the separate hook patch 330 as seen in FIG. 3B.

The loop silencer patch 370 comprises an alternative fastener 378 disposed on its body. The alternative fastener is configured to releasably secure the loop silencer patch 370 to a corresponding alternative fastener 348 disposed on the loop patch 340, as seen in FIG. 3C with the body of the loop silencer patch 370 being releasably secured to the body of the loop patch 340 using their alternative fasteners. The alternative fastener is characterized by not being a hook-and-loop-type fastener. In some embodiments, the alternative fastener is a magnet. In FIGS. 3A-C, even though the magnet 348 is disposed within the body of the loop patch 340 behind the surface 342 and the loop fasteners 345, its magnetic attraction with the corresponding magnet 378 on the loop silencer patch 370 is strong enough to releasably secure the loop silencer patch 370 to the loop patch 340, as seen in FIG. 3C.

As discussed above, in some embodiments, in addition to or as an alternative to magnets, the alternative fastener comprises mechanical fasteners, including, but not limited to, mechanical snaps, hooks, sliders, and other types of closures.

Figure 4A:
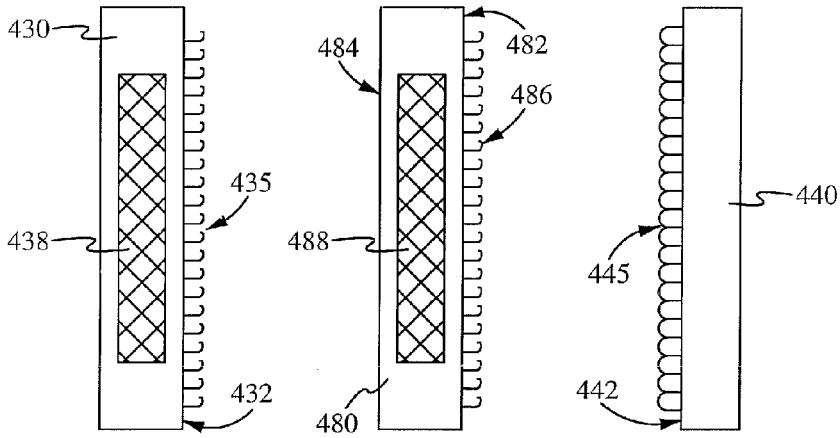
FIGS. 4A-C illustrate yet another embodiment of a silencer patch system in accordance with the principles of the present invention.
Figure 4B:
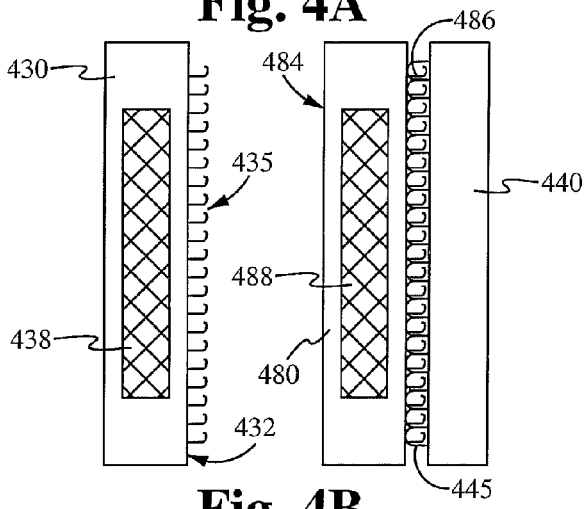
Figure 4C:
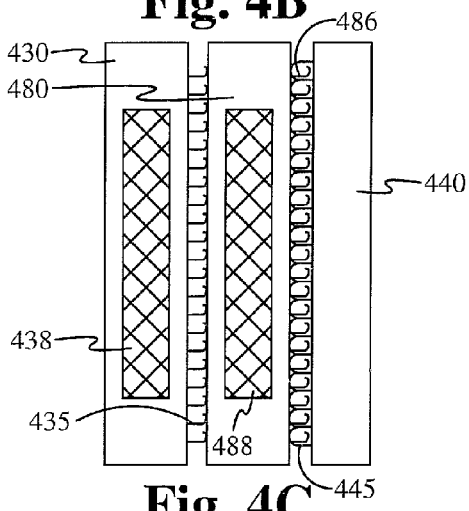

FIGS. 4A-C illustrate one embodiment of a silencer patch system having an alternative fastener built into the hook side of the existing hook-and-loop-type closure system on the target article. In this embodiment, the hook patch 430 and the loop patch 440 represent an existing hook-and-loop-type closure system securely fixed on a target article, similar to the hook-and-loop patches 230 and 240 discussed above with respect to FIGS. 2A-C. The hook patch 430 comprises a plurality of hooks (e.g., a hook matrix) 435 extending out from its exposed surface 432. The loop patch 440 comprises a plurality of loops (e.g., a loop matrix) 445 extending out from its exposed surface 442. In some embodiments, one of the patches 430 and 440 is fixed to the main body of a bag, such as main body 110 of messenger bag 100, while the other patch is fixed to the flap of the bag, such as the flap 120 of messenger bag 100. In some embodiments, the body of patches 430 and 440 are fastened (e.g., sewn, adhered, etc.) to the target article, while in other embodiments, the body of patches 430 and 440 are integrally formed with the target article.

The silencer patch system in FIGS. 4A-C also comprises a hook silencer patch 480. The hook silencer patch 480 comprises a body having a first surface 482 and a second surface 484 opposite the first surface 482. Although the surfaces 482 and 484 are shown as being substantially planar, it is contemplated that the surfaces of the hook silencer patch 480 can be formed in a variety of ways. A plurality of hook-and-loop-type fasteners 486 is disposed on and extends from the first surface 482 of the hook silencer patch 480. The plurality of hook-and-loop-type fasteners 486 comprises a plurality of tiny hooks configured to releasably secure the first surface 482 of the hook silencer patch 480 to the corresponding plurality of loops 445 disposed on the separate loop patch 430 as seen in FIG. 4B.

The hook silencer patch 480 comprises an alternative fastener 488 disposed on its body. The alternative fastener is configured to releasably secure the hook silencer patch 480 to a corresponding alternative fastener 438 disposed on the hook patch 430, as seen in FIG. 4C with the body of the hook silencer patch 480 being releasably secured to the body of the hook patch 430 using their alternative fasteners. The alternative fastener is characterized by not being a hook-and-loop-type fastener. In some embodiments, the alternative fastener is a magnet. In FIGS. 4A-C, even though the magnet 438 is disposed within the body of the hook patch 430 behind the surface 432 and the loop fasteners 435, its magnetic attraction with the corresponding magnet 488 on the hook silencer patch 480 is strong enough to releasably secure the hook silencer patch 480 to the hook patch 430, as seen in FIG. 4C.

As discussed above, in some embodiments, in addition to or as an alternative to magnets, the alternative fastener comprises mechanical fasteners, including, but not limited to, mechanical snaps, hooks, sliders, and other types of closures.

Figure 5:
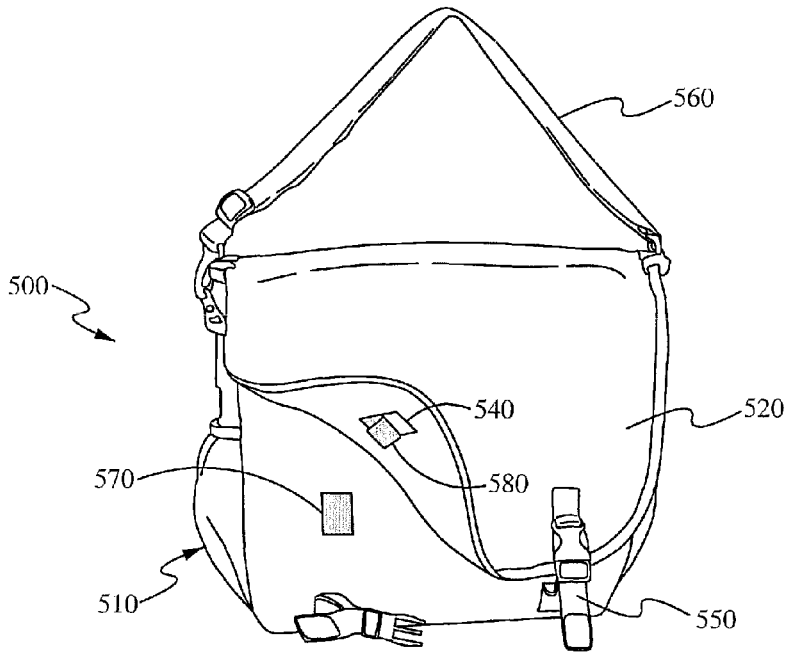
FIG. 5 illustrates one embodiment of a messenger bag utilizing a silencer patch system in accordance with the principles of the present invention.

FIG. 5 illustrates on embodiment of a messenger bag 500 utilizing a silencer patch system in accordance with the principles of the present invention. The messenger bag 500 is similar to the bag 100 in FIG. 1A, featuring a hook-and-loop flap closure. Hook-and-loop patches, such as the patch 540, are disposed on the main body 510 of the bag 500 and on the inside of the flap 520 of the bag 500. The hook-and-loop patches are often accompanied by the plastic buckles 550, which are used to secure the flap 520 to the main body 510 for added security. Additionally, a strap 560 is often included to aid in carrying the bag 500.

Unlike the bag 100, the bag 500 utilizes the silencer patch system of the present invention in order to releasably secure the flap 520 to the main body 510. The silencer patches 570 and 580, such as those discussed above with respect to FIGS. 2-4, are placed over the existing hook-and-loop-type patches on the flap 520 and the main body 510. In FIG. 5, the silencer patch 570 is shown completely covering the existing hook-and-loop-type patch to which it is attached, while the silencer patch 580 is shown partially covering the existing hook-and-loop-type patch to which it is attached (as if it were being peeled off). Using their alternative fasteners, the silencer patches 570 and 580 allow the user to releasably secure the flap 520 to the main body 510, while avoiding the negative effects of the bag's built-in hook-and-loop-type fasteners.

As discussed above, in some embodiments, the alternative fasteners comprise magnets. Additionally, in some embodiments, the magnets are substituted or supplemented with mechanical fasteners, including, but not limited to, mechanical snaps, hooks, sliders, and other types of closures, providing a means of retrofitting hook-and-loop-type closure systems with alternative closure systems, using the existing hook-and-loop-type patches as anchor pads for the retrofit mechanism.

In some embodiments, the silencer patches and/or their corresponding hook-and-loop patches comprise two or more magnets (or other alternative fasteners) spaced uniformly in a vertical orientation to form two or more mating rows or locations. In this configuration, the user can chose between two or more different closure positions. For example, with a messenger bag, the user could mate a magnet on the silencer patch of the flap to one of a plurality of uniformly spaced magnets on a corresponding patch of the main body.

Figure 6A:
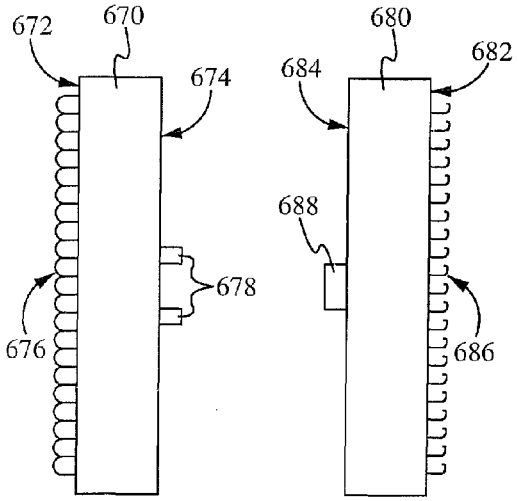
FIGS. 6A-B illustrate one embodiment of a silencer patch system utilizing snap fasteners in accordance with the principles of the present invention.
Figure 6B:
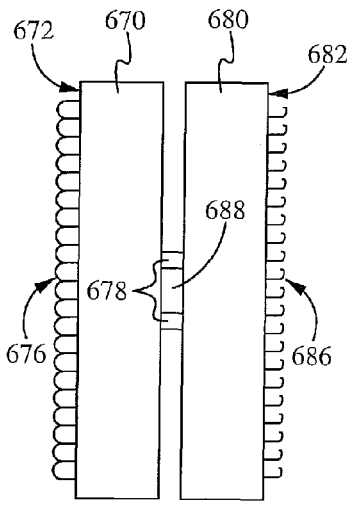

FIGS. 6A-B illustrate one embodiment of a silencer patch system utilizing a snap fastener system as the alternative fasteners. The silencer patch system in FIGS. 6A-B comprises a loop silencer patch 670 and a hook silencer patch 680. The loop silencer patch 670 comprises a body having a first surface 672 and a second surface 674 opposite the first surface 672. Although the surfaces 672 and 674 are shown as being substantially planar, it is contemplated that the surfaces of the loop silencer patch 670 can be formed in a variety of ways. A plurality of hook-and-loop-type fasteners 676 is disposed on and extends from the first surface 672 of the loop silencer patch 670. The plurality of hook-and-loop-type fasteners 676 comprises a plurality of tiny loops configured to releasably secure the first surface 672 of the loop silencer patch 670 to the corresponding plurality of hooks disposed on a separate hook patch, as previously discussed.

Similarly, the hook silencer patch 680 comprises a body having a first surface 682 and a second surface 684 opposite the first surface 682. Although the surfaces 682 and 684 are shown as being substantially planar, it is contemplated that the surfaces of loop silencer patch 680 can be formed in a variety of ways. A plurality of hook-and-loop-type fasteners 686 is disposed on and extends from the first surface 682 of the hook silencer patch 680. The plurality of hook-and-loop-type fasteners 686 comprises a plurality of tiny hooks configured to releasably secure the first surface 682 of the hook silencer patch 680 to the corresponding plurality of loops disposed on a separate loop patch, as previously discussed.

The loop silencer patch 670 comprises a female member 678 of a snap fastener system disposed on its second surface 674, while the hook silencer patch 680 comprises a male member 688 of a snap fastener system disposed on its second surface 684. The female member 678 and the male member 688 are configured to mate and releasably interlock (as seen in FIG. 6B), thereby providing an alternative securing mechanism beyond the existing hook-and-loop-type closure system.

The present invention includes retrofit and built-in modes, as well as implementations employing one or more pairs of magnets and other mechanical closure systems. As a result of providing a means for allowing a user to employ an alternative fastener system instead of the standard existing hook-and-loop-type fastener system, the present invention provides several benefits. Such benefits include: (1) silencing of the noise caused when using existing hook-and-loop closure systems; (2) eliminating garment damage; (3) eliminating bag damage; (4) improving cosmetic appearance by preventing collection of lint, thread and hair; (5) preserving hold strength of the original hook-and-loop closure systems; (6) improving the perceived value of the product by concealing the existing hook-and-loop system, adding color to the patches for cosmetic accent, and/or adding alternative mechanical closure mechanisms to enhance actual and perceived value; and (7) being field-retrofittable to any bag employing a hook-and-loop closure system.

There are also specific benefits associated with the present invention's implementation of magnets as the alternative fasteners. Such benefits include: (1) providing a positive closure without the aid of any other mechanical assistance, such as cinching buckles; (2) keeping the flap secure and aligned with the bag without the aid of any other mechanical assistance, such as cinching buckles; (3) providing multiple closure positions, determined by the magnet spacing and the number of magnets arranged on either side of the system; and (4) the magnet strength will not degrade with time or usage.

While the present invention has been discussed in terms of its applicability to existing hook-and-loop closure systems on bags, particularly messenger bags, it is contemplated that the silencer patches of the present invention are able to be used with any product to address the problems caused by an existing hook-and-loop closure system present on that product.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the claims.

What is claimed is:

1. A silencer system comprising:

a first separate body comprising a corresponding set of hook-and-loop-type fasteners;

a body having a first surface on a first side and a second surface on a second side opposite the first side, wherein the second surface comprises a relatively smooth surface without hook-and-loop-type fasteners covering the majority of the second side;

a set of hook-and-loop-type fasteners disposed on the first surface of the body such that the set of hook-and-loop-type fasteners cover the majority of the first side of the body having the first surface, wherein the set of hook-and-loop-type fasteners comprises either a plurality of hooks or a plurality of loops to releasably secure the first surface of the body to the corresponding set of hook-and-loop-type fasteners disposed on the first separate body; and an alternative fastening mechanism coupled to the body to releasably secure to a corresponding alternative fastening mechanism, wherein the alternative fastening mechanism comprises one or more magnets.

2. The silencer patch of claim 1, wherein the set of hook-and-loop-type fasteners comprises a plurality of hooks.

3. The silencer patch of claim 1, wherein the set of hook-and-loop-type fasteners comprises a plurality of loops.

4. A silencer system comprising:

a first separate body comprising a corresponding set of hook-and-loop-type fasteners;

a second separate body comprising a corresponding alternative fastener;

a body having a first surface on a first side and a second surface on a second side opposite the first side;

a set of hook-and-loop-type fasteners disposed on the first surface of the body such that the set of hook-and-loop-type fasteners cover the majority of the first side of the body having the first surface, wherein the set of hook-and-loop-type fasteners comprises either a plurality of hooks or a plurality of loops to releasably secure the first surface of the body to the corresponding set of hook-and-loop-type fasteners disposed on the first separate body; and an alternative fastener disposed on the body to releasably secure the second surface of the body to the corresponding alternative fastener disposed on the second separate body, wherein the alternative fastener is not a hook-and-loop-type fastener, wherein the alternative fastener comprises one or more magnets.

5. The silencer patch of claim 4, wherein the set of hook-and-loop-type fasteners comprises a plurality of hooks.

6. The silencer patch of claim 4, wherein the set of hook-and-loop-type fasteners comprises a plurality of loops.

7. The silencer patch of claim 4, wherein the alternative fastener comprises the one or more magnets enclosed within the body between the first surface and the second surface.

8. The silencer patch of claim 7, wherein the alternative fastener is disposed between layers of fabric.

9. A silencer system comprising:

a first hook-and-loop surface disposed on a first hook-and-loop body of a bag and comprising a set of hook-and-loop-type fasteners, wherein the set of hook-and-loop-type fasteners on the first hook-and-loop surface comprises either a plurality of hooks or a plurality of loops;

a first patch body having a first surface, a second surface opposite the first surface, a set of hook-and-loop-type fasteners disposed on the first surface of the first patch body, and a first alternative fastener;

a second hook-and-loop surface disposed on a second hook-and-loop body of a bag and comprising a set of hook-and-loop-type fasteners, wherein the set of hook-and-loop-type fasteners comprises either a plurality of hooks or a plurality of loops; and a second alternative fastener disposed on the second hook-and-loop body;

wherein the set of hook-and-loop-type fasteners on the first patch body comprises either a plurality of hooks or a plurality of loops and is configured to releasably secure the first surface of the first patch body to the set of hook-and-loop-type fasteners disposed on the first hook-and-loop surface, wherein the first alternative fastener is configured to releasably secure the second surface of the first patch body to a corresponding alternative fastener disposed on a separate body, wherein the first alternative fastener is not a hook-and-loop-type fastener, and wherein the second alternative fastener is configured to releasably secure the second hook-and-loop body to the first alternative fastener disposed on the first patch body, and the second alternative fastener is not a hook-and-loop-type fastener.

10. The silencer system of claim 9, wherein the first alternative fastener and the second alternative fastener each comprises one or more magnets.

11. The silencer system of claim 10, wherein the second alternative fastener comprises one or more magnets encased within the second hook-and-loop body and disposed underneath the second hook-and-loop surface.

12. A silencer system comprising:

a first hook-and-loop surface disposed on a first hook-and-loop body and comprising a set of hook-and-loop-type fasteners, wherein the set of hook-and-loop-type fasteners on the first hook-and-loop surface comprises either a plurality of hooks or a plurality of loops;

a first patch body having a first surface, a second surface opposite the first surface, a set of hook-and-loop-type fasteners disposed on the first surface of the first patch body, and a first alternative fastener;

a second hook-and-loop surface disposed on a second hook-and-loop body and comprising a set of hook-and-loop-type fasteners, wherein the set of hook-and-loop-type fasteners comprises either a plurality of hooks or a plurality of loops; and a second alternative fastener disposed on the second hook-and-loop body;

wherein the set of hook-and-loop-type fasteners on the first patch body comprises either a plurality of hooks or a plurality of loops and is configured to releasably secure the first surface of the first patch body to the set of hook-and-loop-type fasteners disposed on the first hook-and-loop surface, wherein the first alternative fastener is configured to releasably secure the second surface of the first patch body to a corresponding alternative fastener disposed on a separate body, wherein the first alternative fastener is not a hook-and-loop-type fastener, and wherein the second alternative fastener is configured to releasably secure the second hook-and-loop body to the first alternative fastener disposed on the first patch body, and the second alternative fastener is not a hook-and-loop-type fastener;

wherein the first hook-and-loop body and the second hook-and-loop body are both disposed on a messenger bag; and further wherein the set of hook-and-loop fasteners on the first hook-and-loop surface are configured to releasably interlock with the set of hook-and-loop-type fasteners on the second hook-and-loop body.

* * * * *